United States Patent [19]

Kaufmann et al.

[11] 4,392,863

[45] Jul. 12, 1983

[54] METHOD OF UNIFORMLY DYEING HIGH TEMPERATURE HEAT SET POLYESTER YARN

[75] Inventors: John C. Kaufmann; Ronald S. Lenox, both of Lancaster, Pa.

[73] Assignee: Armstrong World Industries, Inc., Lancaster, Pa.

[21] Appl. No.: 335,759

[22] Filed: Dec. 30, 1981

[51] Int. Cl.[3] ..... D06P 5/00; B29C 25/00

[52] U.S. Cl. ..... 8/400; 8/491; 8/922; 8/930; 264/40.1; 264/40.6; 264/342 R; 264/345; 264/346

[58] Field of Search ..... 8/400, 491; 264/40.1, 264/40.6, 342 R, 345, 346

[56] References Cited

U.S. PATENT DOCUMENTS 3,081,485 3/1963 Steigerwald ..... 264/40.6
4,183,895 1/1980 Luise ..... 264/345

OTHER PUBLICATIONS

Berndt and Bossman, "Thermal Analysis of Heat Set Poly(ethylene Terephthalate Fibers", Polymer, 1976, vol. 17, Mar., pp. 241–245.

*Primary Examiner*—A. Lionel Clingman

[57] ABSTRACT

A method is disclosed of pretreating a plurality of high temperature heat set yarn bundles, e.g. polyester, that have different heat histories but are otherwise identical, to enable said yarns to be dyed uniformly. The method comprises measuring the pre-melt crystallization temperature of each polyester yarn bundle and thereafter heat treating each yarn bundle at a uniform temperature that is at least the same as or higher than the highest measured pre-melt crystallization temperature. Also disclosed are a method of uniformly dyeing polyester yarn bundles that are treated in a plurality of high temperature heat setting units and a method of determining the evenness of the internal temperature of high temperature heat setting apparatus.

4 Claims, No Drawings

METHOD OF UNIFORMLY DYEING HIGH TEMPERATURE HEAT SET POLYESTER YARN

During the manufacture of polyester fiber or yarn, the drawn polyester filament is subject to a variety of processing steps in which high temperature heat is applied. These steps collectively form what is known as the "heat history" of the fiber. It is common practice to thereafter expose the manufactured fiber to high temperatures prior to dyeing the fiber. This is known in the art as "heat setting" or "heat treating" the fibers or yarn, and it is believed that such a procedure improves the wear performance of the fiber.

The high temperature heat set material and, in particular, the polyester (which in the present application and claims, refers to both 100% polyester material and blends of polyester and other textile material) and nylon material which is subject to the present method comprise yarns, fibers, filament and thelike which are subject to high temperature heat setting prior to being dyed. The terms "yarns" and "fibers" are used interchangeably in the present specification and claims and should be taken to include either and any form of such material.

It has been found that there is a direct correlation between the uniform dyeability of polyester fibers or yarn and both the heat history and the heat setting conditions experienced by the yarn or fiber. This is in most part attributed to two facts, the first of which is that a polyester fiber will "remember" the highest temperature it experiences during its heat history and heat setting steps. In effect, it is believed that the morphology of polyester fibers is directly influenced by the highest temperature such fibers experience. Secondly, it is believed that the fiber uptake of dyes is directly related to the highest temperature (hereinafter alternatively referred to as HT) experienced by the yarn, whether it be during the processing stage or during the heat treating stage. It has been shown that two otherwise identical fibers that have experienced different HT's will also have correspondently different capacities for dye uptake. This problem is compounded by the fact that it is now very popular in the carpet industry to heat set polyester yarn in so-called "high temperature" ovens, in which temperatures between about 180° C. and 210° C. are reached, and that at such high temperatures there are large changes in the dye uptake capacity of otherwise identical polyester fibers. One particularly popular high temperature oven is the Suessen unit, distributed by American Suessen, Inc.

From the foregoing, it is apparent that there are certain circumstances in which it will normally be very difficult, if not impossible, to uniformly dye a plurality of otherwise identical (both in composition and by commercial brand) polyester fibers. The first of these circumstances takes place when otherwise identical fibers that have different heat histories are heat set at temperatures that, for some or all of the fibers, are below the highest temperature experienced by the fiber during processing. It has been discovered that these fibers will dye unevenly, and can in fact only be dyed evenly if they are heat treated at substantially identical temperatures that are higher than the highest temperature experienced by any of the fibers during manufacture.

It has been discovered that the pre-melt crystallization temperature of a polyester yarn will mirror the highest temperature "seen" by the yarn, either during its manufacture or during heat treatment. It has also been discovered that the problem of evenly dyeing a plurality of yarn bundles that have different heat histories can be overcome by first measuring the pre-melt crystallization temperature (Tpmc) of a sample of each polyester yarn bundle to thereby determine the highest temperature experienced by the yarn during manufacture. Once knowing the Tpmc for each yarn bundle, one will thereafter heat each polyester yarn bundle at temperatures that vary by no more than 5° C. and that are at least the same as or higher than the highest measured pre-melt crystallization temperature. Yarn thus pre-treated will dye substantially evenly.

It has also been discovered that polyester yarns will not dye evenly when otherwise identical yarns that have similar or different heat histories are heat treated (or heat set) at temperatures that vary significantly, even when such temperatures are, in every instance, above the highest temperature "seen" by the yarns during manufacture. Such is especially the case when polyester yarns are heat treated at temperatures greater than 160° C. At such temperatures, varying the HT seen by the yarn by as little as 5° C. will cause a significant difference in the fiber's dyeability. The problem is compounded by the fact that manufacturers use a plurality of dry heat high temperatures heat setting units. Such units are normally in the form of tunnels or chambers, ranging from 5 to 15 feet long, through which the yarns are run. A standard Suessen high temperature unit, for example, has 6 tunnels, each of which are approximately 10 feet long. Although it would, of course, be desirable to operate all the tunnels at the same temperature, for practical purposes it is known that there will be temperature variances from tunnel to tunnel, even when such tunnels are set at similar temperatures. Furthermore, it is known that temperatures of such tunnels will vary within the tunnel itself. In such instances, the dyeability of the yarn will depend as explained above, on the highest temperature inside the tunnel to which the yarn is exposed.

Thus, when yarns are heat treated in a plurality of high temperature heat setting units (or in one unit that has a plurality of tunnels, ovens or chambers) at temperatures that range from about 160° C. to about 210° C., only those yarns, even those that have similar heat histories during their manufacture, that are heat treated at roughly equivalent temperatures (within about 5° C. of each other) can be uniformly dyed. Therefore, when a plurality of high temperature heat setting units are utilized, the pre-melt crystallization temperature of yarn heat treated in each heat setting unit should be measured. Only those yarns that have pre-melt crystallization temperatures within no more than about 5° C. of each other should be merged on a tufting machine and then dyed.

Another problem associated with high temperature heat setting units is that in the past it has been difficult to accurately measure the highest temperature within a high temperature heat setting unit tunnel. It is also exceedingly difficult to accurately and precisely adjust the temperatures of each tunnel in a unit so that the unit is in balance.

It has been discovered that a heat set polyester yarn's pre-melt crystallization temperature is identical to the highest temperature the polyester yarn is exposed to within a heat set tunnel. It becomes a simple matter, therefore, to balance a high temperature heating unit that is comprised of a number of tunnels, or a plurality of such units, by running a polyester yarn through each tunnel, measuring the yarn's Tpmc to hereby determine the highest temperature at which that tunnel or unit is running and thereafter making any necessary adjustments to the unit or tunnel. It may be necessary, of course, to repeat these procedures a number of times until the unit is balanced, i.e. until the temperature variance between the hottest and coolest tunnel is no more than about 5° C., and preferably no more than about 2° C.

The adjustments that are to be made will depend, of course, on the particular high temperature heat set unit that is employed. A Suessen heat set unit, for example, is adjusted by two procedures:

(1) controlling the air flow by adjusting the width of the throat in each tunnel. The width adjustments are made by adding or taking away small spacers until the desired temperature profile is attained as measured by thermocouple readings taken at several locations in the tunnel. This adjustment procedure is done when no yarn is present in the tunnel and represents a static adjustment procedure in that the thermocouples are advanced through the tunnel to the desired location and held until their output becomes constant. A temperature reading is then taken after which the thermocouples are advanced; and (2) setting the desired heat setting temperature on the control panel.

The method described above of measuring the Tmpc of polyester yarn permits the maximum temperatures seen by each yarn to be determined under dynamic production conditions for multiple tunnels and units.

Although the foregoing is concerned with a method for uniformly dyeing a plurality of otherwise identical polyester yarns that either have different heat histories or are heat set at different temperatures, it should be noted that other high temperatures heat set yarns beside polyester (for example, and most notedly, nylon) present problems with regard to uniform dyeability. In this regard, the present invention provides a method of ascertaining the highest temperatures experienced by the high temperature heat set fiber such as nylon during heat treatment and thereby ascertaining which fibers or yarn may be merged for dyeing. This method comprises "tagging" the nylon yarn with a section of polyester yarn and then, after the nylon yarn is heat set, measuring the Tpmc of the polyester yarn that accompanied the nylon yarn through the heat set oven. Such a measurement will provide the practitioner of this invention with the highest temperature experienced by the nylon yarn in the oven. Thereafter, to achieve uniform dyeing, only yarns which were heat treated at substantially equivalent (within 5° C. of each other) temperatures would be merged on a common tufting machine.

The "tagging" procedure mentioned can be done in any of a number of ways depending on the needs of the individual practitioner of this invention and as such the exact procedure employed is not crucial to this invention. For example, a small amount of polyester yarn may be tied on to the length of nylon yarn or be placed in close proximity to the nylon yarn and thereafter accompany it through the oven.

EXAMPLE 1

This example illustrates the invention's method of balancing a high temperature heat setting oven.

Two identical Suessen heat setting ovens, each containing six heat tunnels, were cleaned and set at 191° C. Two DuPont T-776 polyester yarns were run through each tunnel. The Tmpc of each yarn was measured by a DuPont Model 900 Thermal Analyzer unit. Table 1 sets forth the resulting data.

TABLE 1

| | Suessan #1 Tmpc (°C.) | | | Suessan #2 Tmpc (°C.) | | |
|---|---|---|---|---|---|---|
| Tunnel # | Yarn A | Yarn B | Average | Yarn A | Yarn B | Average |
| 1 | 190 | 190 | 190 | 192 | 192 | 192 |
| 2 | 191 | 190 | 191 | 188 | 191 | 190 |
| 3 | 191 | 190 | 191 | 184 | 186 | 186 |
| 4 | 190 | 192 | 191 | 188 | 186 | 187 |
| 5 | 191 | 191 | 191 | 190 | 189 | 190 |
| 6 | 192 | 191 | 192 | 188 | 190 | 189 |

The data indicated that each of the tunnels in the No. 1 Suessen unit were running at substantially the same temperature. The average temperature difference between the hottest tunnel (#6) and the coolest (#1) was only 2° C., an amount that would not significantly affect the dyeability of the fibers heat set therein. By contrast, there was a larger average temperature difference (6° C.) between the hottest (#1) and coolest (#3) tunnels in the No. 2 Suessen unit. The fibers heat treated in the No. 2 unit could not be dyed as uniformly as those treated in the No. 1 unit.

Each of the tunnels in the No. 2 unit were then adjusted. Fibers were run through each tunnel after each adjustment to determine, by the method set forth above, if the unit was in balance. The adjustments were continued until the unit was substantially balanced.

EXAMPLE 2

This example illustrates the present invention's method of uniformly dyeing otherwise identical polyester yarns that have different heat histories.

Two yarn samples of Hoechst Trevira T-816 polyester having Tmpc values of, respectively, 150° C. and 160° C. were both Suessen heat set to a Tmpc of 190° C., merged and tufted into a cut pile carpet construction and beck dyed using disperse dyes. The dyed tufted goods were examined and were found to be evenly dyed.

EXAMPLE 3

This example illustrates the present invention's ability to detect potential dyeing differences in polyester fiber or yarn as received from a fiber or yarn manufacturer. Samples of fiber were taken from each of six Du Pont T-776 polyester fiber bales. The Tmpc of each bundle was measured by a Du Pont Thermal Analyzer (Model 990) unit. Tmpc values were determined for each bale. The Tmpc values are set forth in Table 2.

TABLE 2

| Bale No. | Tmpc °C. |
|---|---|
| 1 | 162.5, 164, 162, 173 |
| 2 | 164.5, 164 |
| 3 | 173.5, 170 |
| 4 | 177, 178 |
| 5 | 154.5, 153 |
| 6 | 176.5, 175 |

The values of Tmpc vary from bale to bale. In particular, bale No. 1 shows the presence of fibers with two very distinct thermal histories (173° C. and approximate 163° C.). Bale No. 5 indicates a fiber with an extremely low value of Tmpc when compared to the values of the other fibers.

We claim:

1. A method of pre-treating a plurality of otherwise identical polyester yarns that have different heat histories, to enable said yarns to be dyed uniformly, which method comprises measuring the pre-melt crystallization temperatures of each polyester yarn and thereafter heat treating each yarn at temperatures that vary by no more than 5° C. and that are at least the same as or higher than the highest measured pre-melt crystallization temperature.

2. A method of uniformly dyeing otherwise identical polyester yarns that are heat treated at temperatures ranging from about 160° C. to about 210° C. in a plurality of high temperature heat setting ovens, which method comprises measuring the pre-melt crystallization temperature of yarn heat treated in each heat setting oven and, prior to the dyeing operation, merging those yarns for dyeing that have pre-melt crystallization temperatures within no more than 5° C. of each other.

3. A method of balancing the temperatures of a high temperature heat setting unit that is comprised of a plurality of heat tunnels which method comprises (a) setting the unit at the desired temperature, (b) running polyester yarns through each tunnel, (c) measuring the pre-melt crystallization temperature of each yarn to thereby determine the highest temperature within each tunnel, and (d) adjusting the temperatures of each tunnel to achieve uniform tunnel temperature so that the temperature variance between the hottest and coolest tunnel is no more than about 5° C.

4. The method of claim 3 wherein, in step (d), the temperature variance between the hottest and the coolest tunnel is no more than about 2° C.

* * * * *